United States Patent [19]

Kamiya

[11] 4,269,127

[45] May 26, 1981

[54] TRIMMING DEVICE FOR SEWING MACHINES

[75] Inventor: Osamu Kamiya, Nagoya, Japan

[73] Assignee: Brother Kogyo Kabushiki Kaisha, Nagoya, Japan

[21] Appl. No.: 46,690

[22] Filed: Jun. 8, 1979

[30] Foreign Application Priority Data

Jun. 15, 1978 [JP] Japan ..... 53-72761

[51] Int. Cl.[3] ..... D05B 37/00

[52] U.S. Cl. ..... 112/122; 112/261

[58] Field of Search ..... 112/122, 123, 125, 126, 112/261, 127, 128, 129, 77, 160

[56] References Cited

U.S. PATENT DOCUMENTS

| | | | |
|---|---|---|---|
| 212,602 | 2/1879 | Ingalls | 112/128 |
| 1,223,718 | 4/1917 | Moffatt | 112/127 X |
| 1,602,144 | 10/1926 | Avis | 112/126 |
| 1,994,385 | 3/1935 | Chudner | 112/122 |
| 3,082,720 | 3/1963 | Sanbe | 112/160 X |
| 3,127,856 | 4/1964 | Taketomi | 112/160 X |
| 3,149,590 | 9/1964 | Fowler | 112/127 |

*Primary Examiner*—H. Hampton Hunter
*Attorney, Agent, or Firm*—George B. Oujevolk

[57] ABSTRACT

A trimming device for sewing machines to trim the marginal edge of work fabric by a cooperation of a stationary blade fixed to the end of a projection arm, and a movable blade fixed to a drive arm positioned above the stationary blade. Between the projection arm and the stationary blade, is a gap for permitting the movable blade to move thereinto. The free end of a resilient plate, which is fixed at its base end portion to the projection arm, normally is substantially in the same horizontal plane as the end of the cutting edge of the stationary blade so as to cover and close the gap. The resilient plate is adapted to be contacted by the movable blade as the latter is lowered to be resiliently deflected into the gap and resume its original position as the movable plate is returned upward, thereby preventing the trimmings from coming into the gap.

5 Claims, 6 Drawing Figures

TRIMMING DEVICE FOR SEWING MACHINES

BACKGROUND OF THE INVENTION

The present invention relates to a trimming device adapted to be removably mounted on a sewing machine bed and be connected to the motion mechanism of the sewing machine, for trimming the marginal edge of a work fabric by the cooperation of a stationary blade and a movable blade in advance to overedge stitching. More particularly, the invention is concerned with a device for easily discharging the trimmings generated as a result of the edge trimming, from the trimming section which is done by the stationary blade and the movable blade.

The trimming device for usé in overedge sewing machines has been well known. In such type of sewing machines, the trimmings generated as a result of the trimming are smoothly discharged from the trimming section through a discharge channel. Therefore, the undesirable stay and accumulation of the trimmings on the sewing machine bed is avoided to ensure a smooth trimming and overedge stitching.

The application of such a trimming device to sewing machines for domestic or household use, which machine is usually a lockstitch sewing machine, has been known also. However, in the household sewing machine, it is impossible to form the guiding channel for positively discharging the trimmings, because such a sewing machine is adapted to perform various kinds of sewing works. As a result, in the household sewing machines, the trimmings are accummulated at the trimming section of the machine and hinder the subsequent trimming work and overedge stitching. In addition, the trimmings tend to undesirably come into the machine bed through the opening for advancement of the movable blade. This is one of the reasons why the household sewing machine equipped with edge trimming device has not been developed and distributed.

SUMMARY OF THE INVENTION

Under these circumstances, the present invention aims as its major object at overcoming the above-stated problems of the prior art.

To this end, the invention provides, as its preferred embodiment, an edge trimming attachment for sewing machines. The attachment has a stationary blade fixed to the end of a projection arm and a movable blade fixed to an end of a drive arm and is adapted to cooperate with the stationary blade in trimming the edge of the work fabric, the movable blade being adapted to be operatively connected to the motion mechanism of the sewing machine, when removable the attachment is attached to the machine bed.

In this attachment, a gap for permitting the advancement of the movable blade is formed between the projection arm and the stationary blade. A thin resilient plate is attached at its base end to the projection arm. The free end of this resilient plate normally occupies substantially the same horizontal plane as the end of the cutting edge of the stationary blade and substantially covers the aforementioned gap. When the movable blade is moved downward, the free end of the resilient plate is contacted by the side surface of the movable blade and is deflected into the aforementioned gap. The free end of the resilient plate is then allowed to resume the normal position as the movable blade is moved upward. The trimmings are therefore never forced into the gap for advancement of the movable blade but, rather, the trimmings are successively discharged without staying in the trimming section as the work fabric is successively fed and trimmed. Therefore, the subsequent overedge stitching is performed smoothly.

DESCRIPTION OF THE PREFERRED EMBODIMENTS

Figure 1:
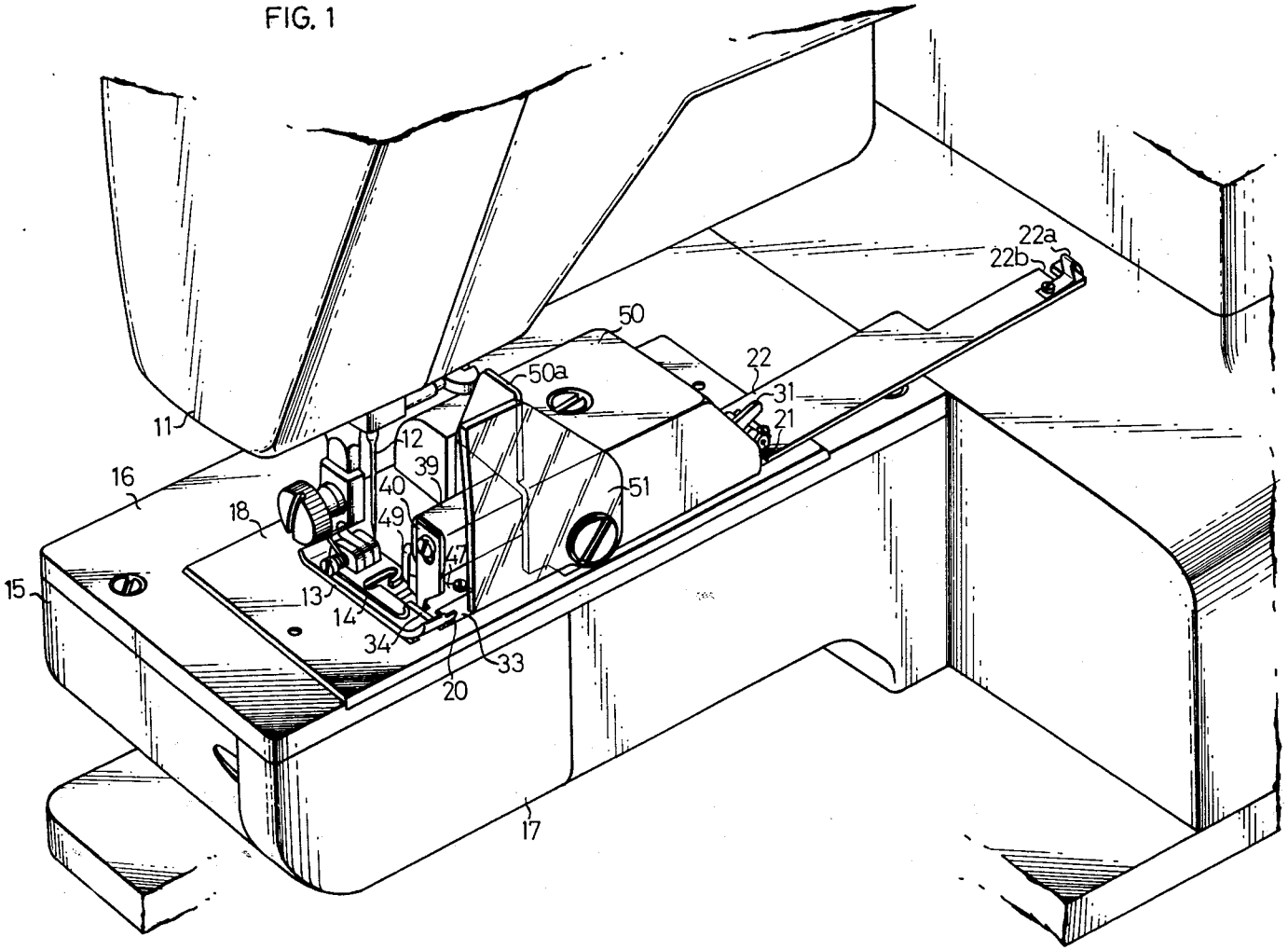
FIG. 1 is a perspective view of the trimming attachment embodying the invention, in the state in which it is attached to the machine bed.

Hereinafter, an attachment type trimming device embodying the invention will be fully described with reference to the accompanying drawings.

Referring to the drawings, a needle bar and a pressure bar which are known per se are attached to the head portion of a bracket arm 11. A needle 12 and a pressure foot 13 are attached to the lower ends of the needle bar and the pressure bar, respectively.

The pressure foot 13 is rotatively biased in the clockwise direction as viewed in FIG. 1, by means of a spring 14, and positively presses the work fabric at its front end. This arrangement ensures a sure feed of the work fabric effected by a feed dog 19 and hence a stable trimming of the marginal edge of the work fabric by the trimming attachment which will be fully described later.

A cylindrical bed 15 of the sewing machine is provided with an upper plate 16 fixed to the upper surface thereof, and a cover 17 open or attached to the front left end portion thereof. A throat plate 18 is attached to the upper front side of the upper plate 16, so as to cooperate with the latter in defining a work supporting surface. The throat plate is formed with an elongated needle aperture **18*a* for zigzag stitching extending perpendicular to the direction of feed of the work fabric. At the lateral sides of the needle aperture 18*a*, formed are a pair of apertures 18*b* for a feed dog 19 so as to extend in the direction of feed of the fabric. Another pair of feed dog apertures 18*c* extending in the direction of feed of fabric are formed also behind the needle aperture 18*a***.

The feed dog 19 is disposed under the throat plate 18 and adapted to impart a feed to the fabric on the work supporting surface through the apertures **18*b* and 18*c*. An opening 20 is formed at the front portion of the throat plate 18, for permitting of attaching of the trimming attachment. As will be seen from FIGS. 2 to 4, the opening 20 merges at its left side rear edge into the front end of the feed dog aperture 18*b* located at the right side of the needle aperture 18*a*. At the substantially central portion of the opening 20 near the rear end edge thereof, as well as between the front and rear edges closer to the right side end of the opening, formed are horizontal supporting seats 20*b* each of which having an aperture 20*a***.

Figure 3:
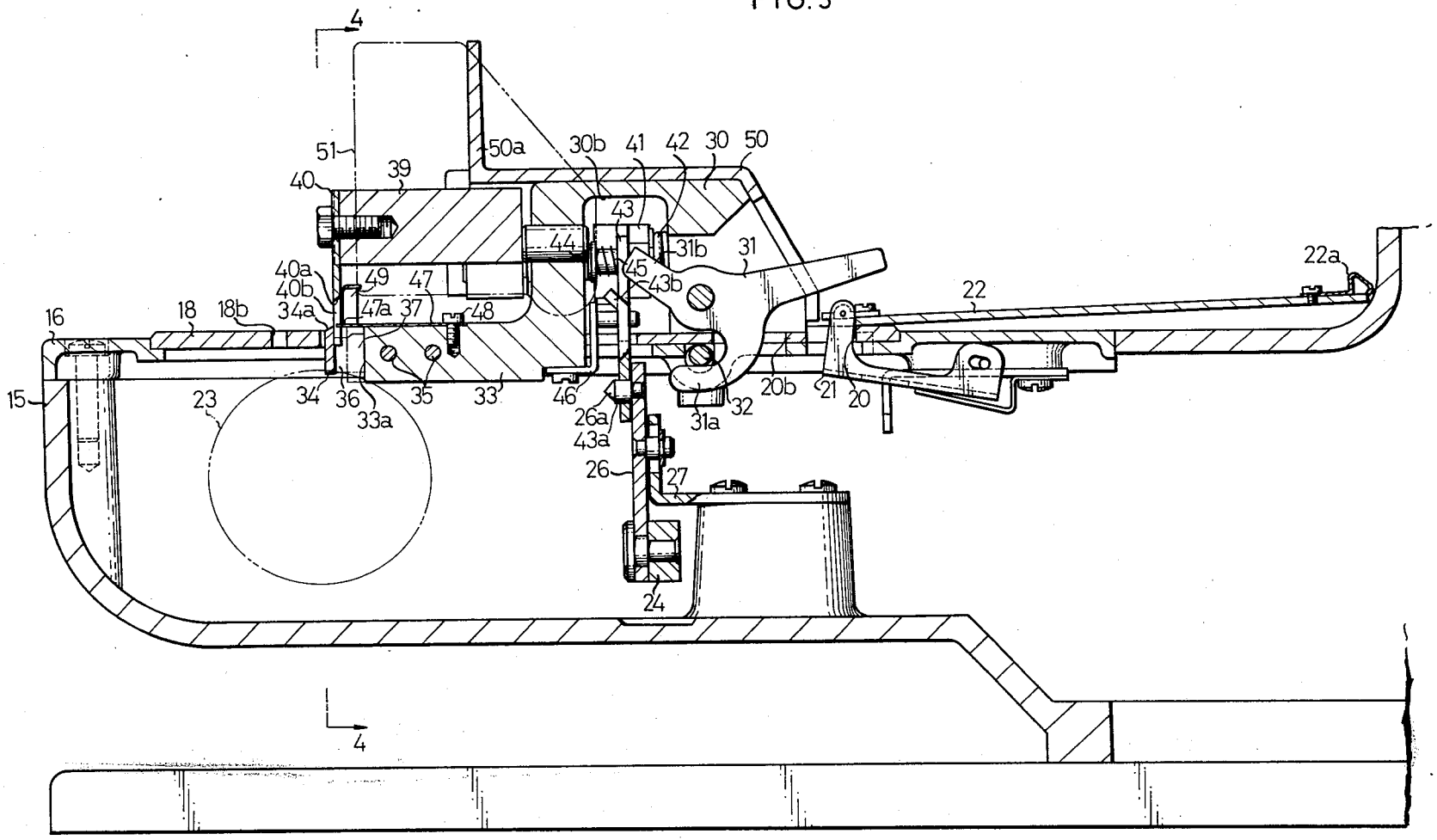
FIG. 3 is a sectional view substantially taken along the line 3—3 of FIG. 2.

A supporting plate 21 which is rotatable is attached to the lower surface of the upper plate 16 so as to project upwardly slightly from the right-hand side end portion of the opening 20 of the throat plate 18. A cover plate 22 is hinged to the upper portion of the lefthand side end of the supporting plate 21, and is adapted to open or close the opening 20. To the free end of the cover plate 22, a resilient retaining plate 22*a* is attached so as to retain the cover plate 22 in the closed position. Also, at the rear side edge of the free end, formed is a notch 22*b* which is adapted to match the feed dog aperture 18*b* at the right side of the needle aperture 18*a* and constitute the front end portion of the aperture 18*b*. For attaching the trimming attachment, the cover plate 22 is rotated to the open position as shown in FIG. 3. However, for ordinary sewing work, this cover plate 22 is rotated to the closed position so as to close the aforementioned opening 20, so that the sewing work may be smoothly performed by making use of the work supporting surface which is formed by the upper surfaces of the upper plate 16, throat plate 18 and the cover plate 22.

A loop taker 23 is disposed in the machine bed 15. An actuating arm 24 is rockably supported in the machine bed by means of a fixed shaft 25. The actuating arm 24 is adapted to be driven by a shaft (not shown) for driving the loop taker 23, through an actuating cam, forked engaging member (not shown) and other associated members.

An actuating link 26 is rotatably attached to the front end portion of the actuating arm 24. As will be seen from FIG. 3, a connection pin 26*a* having a conical surface is formed to project from the left side surface of the upper end portion of the actuating link 26. The actuating link 26 is adapted to be reciprocatingly moved only substantially in the vertical direction, because of the swing-limiting action of the limiting member 27 in the machine bed 15, in accordance with the swinging of the actuating arm 24.

An explanation will be made hereinunder as to the construction of the trimming device which is adapted to be detachably mounted on the throat plate 18 at a portion of the latter near the opening 20, after moving the cover plate 22 to open the opening 20.

Figure 2:
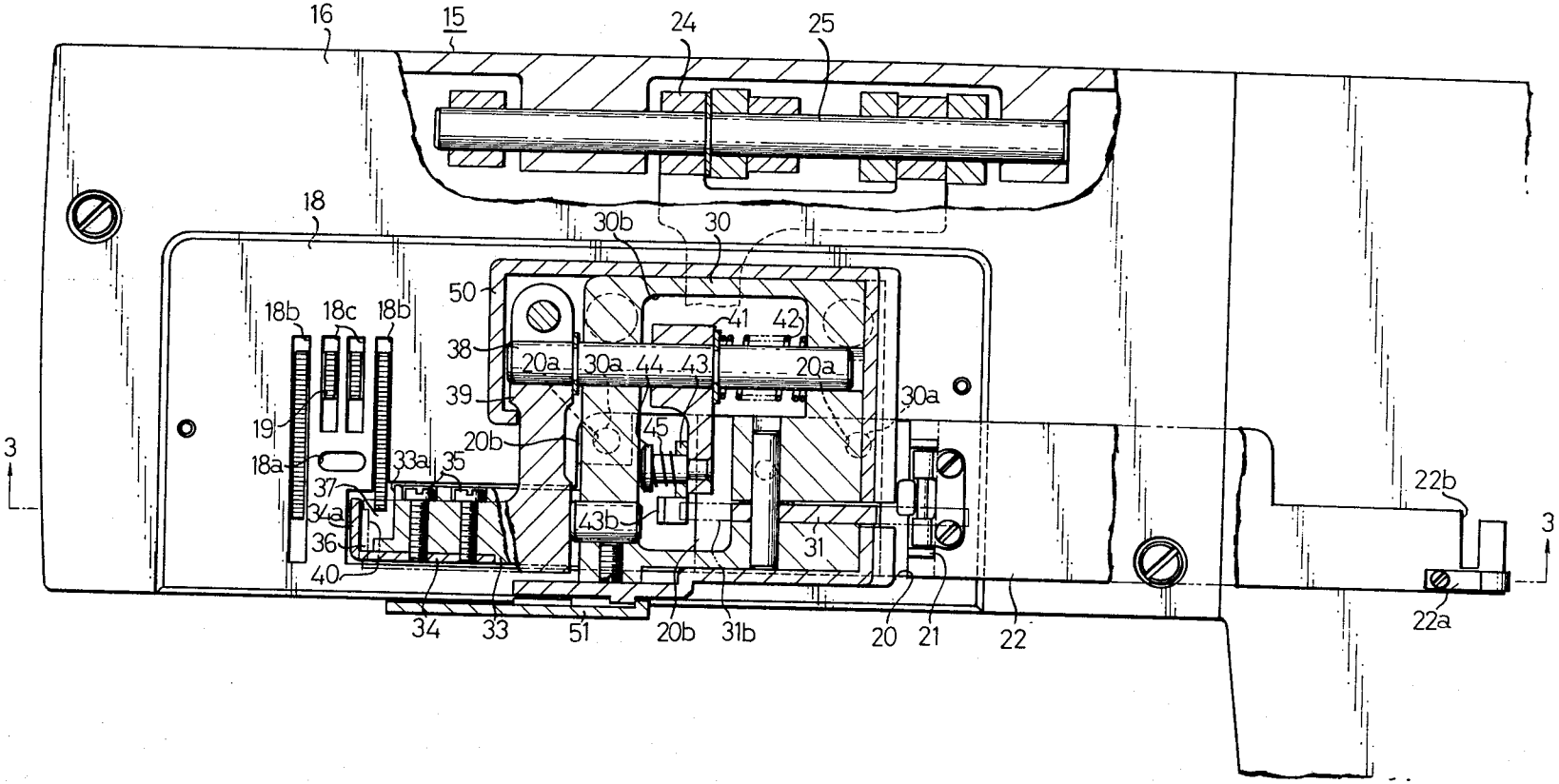
FIG. 2 is a partly sectioned plan view of the trimming attachment as shown in FIG. 1.
Figure 4:
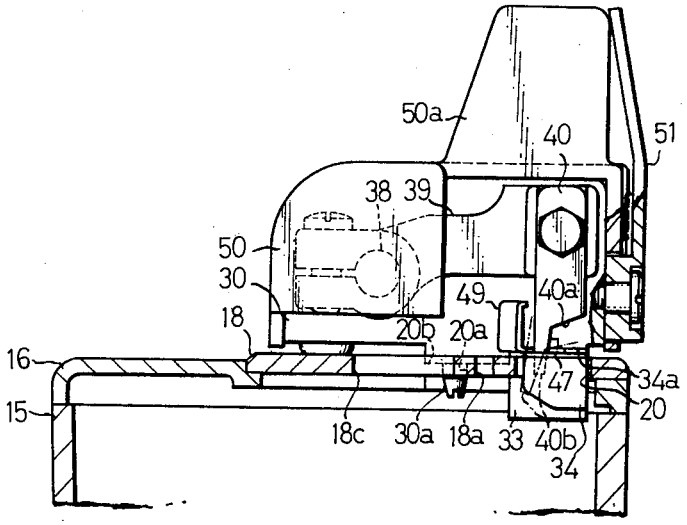
FIG. 4 is a sectional view substantially taken along the line 4—4 of FIG. 3.
Figure 5:
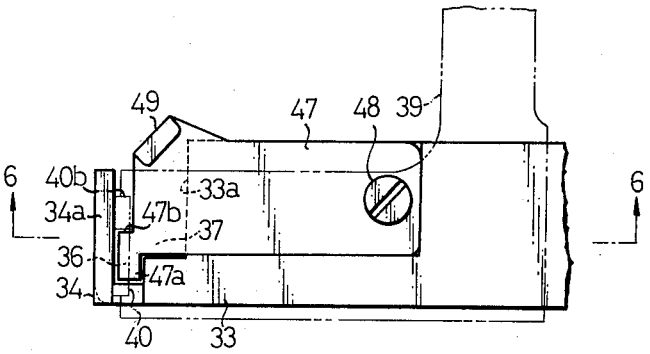
FIG. 5 is an enlarged plan view of the end portion of a projection arm.

A reference numeral 30 denotes an attachment frame provided at its lower surface with a pair of locating pins 30*a* adapted to fit into the pair of apertures 20*a* formed in the supporting seats 20*b* of the throat plate 18, as shown in FIGS. 2 to 4. A downwardly opening accommodation space 30*b* is formed in the attachment frame 30. A lock lever 31 is attached to the right side portion of the attachment frame 30 near the front end of the latter. At the lower end of the lock lever, formed is a latching portion 31*a* which is adapted to engage a shaft 32 fixed to the upper plate 16, from the lower side of the shaft 32, so as to lock the attachment frame 30 against an idle movement. At the left upper portion of the lock lever, formed is an actuating portion 31*b* which projects into the aforementioned accommodation space 30*b*.

A projection arm 33 is formed as a unit with the attachment frame to extend laterally to the left from the lower portion of the front end of the left-hand side part of the attachment frame 30. As will be seen from FIGS. 2 and 3, a notched part 33*a* is formed at the rear part of the left end portion of the projection arm 33. In the attached state of the attachment frame 30, the projection arm 33 is projected into the opening 20 of the throat plate 18 so as to extend in the direction perpendicular to the direction of the feed of the work fabric. In this state, the upper end surface of the projection arm occupies substantially the same plane as the aforementioned work supporting surface or the upper surface of the throat plate 18.

A stationary blade 34 having a substantially L-shaped planar shape is fixed by means of a pair of screws 35, at its base end portion to the left front surface of the projection arm 33 so that it extends leftward beyond the front end of the feed dog 19 placed at the right side of the needle aperture 18*a* and rearwardly toward the needle aperture 18*a*, in the attached state of the attachment frame 30. As will be seen from FIGS. 2 and 3, the cutting edge 34*a* of this stationary blade 34 takes substantially the same plane as the work supporting surface and is located at the front side of the needle aperture 18*a*. At the left portion of the space between the left end of the projection arm 33 and the cutting edge 34*a* of the stationary blade 34, a gap 36 is formed for allowing a later-mentioned movable blade to come thereinto. Also, a gap 37 continuous with the above-mentioned gap 36 for allowing the admission of the movable blade is formed at the rear part of the same space, so as to allow the movement of the front end portion of the feed dog 19 located at the right side of the needle aperture 18*a*, by the aforementioned notched part 33*a* of the projection arm 33.

A drive shaft 38 is rotatably inserted into and rotatably supported by a bore formed at a portion of the attachment frame 30 near the rear end of the latter, so as to extend at a right angle to the direction of feed of the work fabric. A drive arm 39 having a substantially L-shaped planar shape is attached to the left projecting end of the drive shaft 38. As will be seen from FIGS. 2 and 4, the front end of the drive arm 39 extends just above the projection arm 33 in parallel with the latter, and is adapted to move up and down in accordance with the reciprocating rotary motion of the drive shaft 38.

The movable blade 40 is attached to the left end of the head portion of the drive arm 39 so as to take a position above the stationary blade 34. At the lower end of the movable blade 40, is an obliquely extending cutting edge 40*a* and a guide projection 40*b* which extends downwardly. The movable blade 40 is adapted to cooperate with the aforementioned stationary blade 34, in accordance with the reciprocating rotary motion of the drive shaft 38, for trimming the marginal edge of the work fabric which is fed in the direction of feed, in advance of the overedge stitching.

A rocker arm 41 is positioned in the accommodation space 30*b* of the attachment frame 30 and fixed to the substantially central part of the drive shaft 38. A compression spring 42 is disposed between the drive shaft 38 and the left wall of the accommodation space 30*b*, so as to press the movable blade 40 toward the stationary blade 34. A connection arm 43 is connected at its upper end to the front end of the rocker arm 41 for free rotation and movement in the axial direction, by means of an attaching pin 44. As shown in FIG. 3, a bore 43*a* engageable with the connection pin 26*a* of the actuating link 26 is formed at the lower end of the connection arm 43. Also at the substantially central front edge of the connection arm 43, formed by bending is an abutment portion 43*b* which is engageable with the actuating portion 31*b* of the lock lever 31. The connection arm 43 is biased rightwardly in the axial direction, by means of a compression spring 45 provided on the attaching pin 44. A guide member 46 is attached to the attachment frame 30 and is adapted to substantially limit the swinging movement of the connection arm 43 but to allow only the vertical movement of the latter.

As will be seen from FIG. 3, in the attached state of the attachment frame 30, the lower end of the connection arm 43 extends into the machine bed 15 through the opening 20 of the throat plate 18, and the attachment frame 30 is fixed to the throat plate 18 by the rotary locking operation of the lock lever 31. At the same time, the actuating portion **31*b* of the lock lever 31 is disengaged from the abutment portion 43*b* of the connection arm 43 so as to allow the latter to be pressed against the actuating link 26 by the action of the compression spring 45. Then, in the period in which the actuating link 26 makes one cycle of vertical reciprocating motion as a result of the subsequent operation of the sewing machine, the connection pin 26*a* is brought into engagement with the bore 43*a* of the connection arm 43, so that the loop taker-driving shaft (not shown) of the machine actuating mechanism and the drive shaft 38 of the movable blade 40** are operatively connected to each other automatically.

On the other hand, as the lock lever 31 is rotated from the locking position as shown in FIG. 3 in the releasing direction, i.e. counter-clockwisely, the attachment frame 30 is released from the locked state and the actuating portion **31*b* of the lock lever 31 is brought into engagement with the abutment portion 43*b* of the connection arm 43 so that the latter 43 is tilted leftward away from the actuating link 26 overcoming the force of the compression spring 45. As a result, the aforementioned connection pin 26*a* is disengaged from the bore 43*a*** to break the aforementioned operating connection.

Hereinafter, a description will be given to the mechanism for discharging the trimmings of fabric in the trimming section constituted by the stationary blade 34 and the movable blade 40.

A thin resilient plate 47 is fixed at its base portion to the left end upper surface of the projection arm 33 by means of a fixing screw 43. As will be seen from FIGS. 3 to 6, the left side free end of the resilient plate 47 has a covering portion **47*a* which is adapted to cover the gaps 36,37 for allowing the advancements of the movable blade 40 and the feed dog 19, the gaps being formed, as stated before, between the cutting edge 34*a* of the stationary blade 34 and the left end of the projection arm 33. At the left rear side of the covering portion 47*a*, a notched portion 47*b* is formed for avoiding the guide projection 40*b* of the movable blade 40**.

A deflecting part 49 is formed upright on the left rear edge of the resilient plate 47 so as to take a position at the delivery side of the movable blade 40 and in the close proximity of the latter 40.

Figure 6:
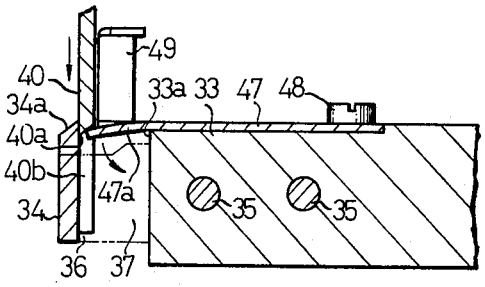
FIG. 6 is a sectional view substantially taken along the line 6—6 of FIG. 5.

As shown in FIG. 3, the covering portion **47*a* of the resilient plate 47 normally occupies substantially the same horizontal plane as the upper end of the cutting edge 34*a* of the stationary blade 34, i.e the work supporting surface formed by the upper surface of the throat plate 18. As the movable blade 40 is lowered for trimming the work fabric, the covering portion 47*a* of the resilient plate 47 is contacted by the movable blade 40 and is deflected gradually to come into the aforementioned gaps 36, 37, as shown in FIG. 6. Then, as the movable blade 40 is raised, the covering portion 47*a* is reset to the normal position shown in FIG. 3, due to its resiliency. Therefore, the trimmings of the fabric produced as a result of trimming work in the trimming section constituted by the stationary blade 34 and the movable blade 40 are lowered or depressed during trimming as a result of the lowering of the movable blade 40 but are never forced into the machine bed 15 through the gaps 36, 37. The trimmings are then discharged rearward as the work fabric is moved rearward by the feed dog 19, and are easily guided and removed rearwards and rightwards by the action of the aforementioned deflecting part 49**.

As shown in FIG. 4, during lowering of the movable blade 40, the covering portion **47*a* of the resilient plate 47 is contacted at first by the base portion of the guide projection 40*b* for the cutting edge 40*a* of the movable blade 40, so that the covering portion 47*a* is sufficiently deflected around the upper edge of the notched part 33*a* of the projection arm 33. Then, as shown in FIG. 6, the tip of the cutting edge 40*a* of the movable blade 40 comes into the gaps formed between the cutting edge 34*a* of the stationary blade 34 and the left end edge of the covering portion 47*a*, so that the wear of the cutting blade 40*a* due to the contact with the covering portion 47*a*** is avoided.

A casing 50 for enclosing the attachment frame 30 is fixed to the latter. As will be seen from FIGS. 1, 3 and 4, a shielding plate portion **50*a* for covering the upper right part of the drive arm 39 is formed at the left upper surface of the casing 50. A transparent protective cover 51 is rotatably attached to the front surface of the attachment frame 30 at the front part near the left end of the casing 50. When the protective cover 51 has been rotated to the operating position as shown in FIGS. 1 to 4, it covers the gap between the drive arm 39 and the projection arm 33 from the front side, so as to exclude danger of insertion of operator's finger into the abovementioned gap or into the trimming section constituted by the stationary blade 34 and the movable blade 40**.

The machine and trimming attachment have the described constructions and operate in the manner hereinafter described.

For performing an overedge stitching while effecting an edge trimming making use of this trimming attachment, at first the cover plate 22 is moved to open the opening 20 of the throat plate 18, and the attachment frame 30 is placed on the portion of the throat plate 18 near the opening 20, so as to locate the attachment frame at the predetermined position by the engagement of vertical pins **30*a* formed on the lower surface of the frame 30 with the apertures 20*a* of the throat plate 18. Subsequently, as the lock lever 31 is rotated to the locking position, the latching portion 31*a* of the lock lever engages the shaft 32 of the lower surface of the upper plate 16 from the lower side of the shaft 32 so as to lock the attachment frame 30. At the same time, the actuating portion 31*b* of the lock lever 31 is disengaged from the abutment portion 43*b* of the connection arm 43. As a result, the lower end of the connection arm 43 in the stated projection in the machine bed 15 through the opening 20 is pressed onto the actuating link 26 by the action of the compression spring 45. As the sewing machine starts to operate in this state, the connection pin 26*a* of the actuating link 26 is brought into engagement with the bore 43*a* of the connection arm 43, before the actuating link makes one full cycle of a vertical reciprocating motion in accordance with the rotation of the driving shaft of the loop taker (not shown). As a result, the drive shaft 38 in the trimming attachment is operatively connected with the loop taker-driving shaft of the motion mechanism in the bed 15**.

As the sewing machine continues to operate, the movable blade 40 is reciprocatingly moved up and down in accordance with the up and downward movement of the actuating link 26 following the rotation of the loop taker-driving shaft, through the actions of the connection arm 43, rocker arm 41, drive shaft 38 and the drive arm 39, so as to cooperate with the stationary blade 34 in trimming the marginal edge of the work fabric. Then, at an area immediately behind the trimming section, the overedge stitching is performed by the cooperation of the machine needle 12 and the loop taker 23.

When the movable blade 40 is lowered for the trimming action, the covering portion 47*a* of the resilient plate 47 disposed in the vicinity of the trimming section is contacted as shown in FIG. 6 by the movable blade 40 and is deflected to come into the gaps 36, 37. Then, as the movable blade 40 is moved upward, the covering portion 47*a* gets back to the normal position as shown in FIG. 3 due to its resiliency. Therefore, the trimmings produced as a result of trimming in the trimming section cannot come into the machine bed 15 through the gaps 36, 37 but are readily discharged from the trimming section rearwards in accordance with the rearward movement of the work fabric caused by the feed dog 19 subsequent to the rise of the covering portion 47*a* and then smoothly guided rearwards and rightwards and removed by the deflecting part 49.

For performing an ordinary sewing operation without employing the trimming attachment, the lock lever 31 is rotated from the locking position shown in FIG. 3 in the counter-clockwise releasing direction. As a result, the latching portion 31*a* is disengaged from the shaft 32 and the attachment frame 30 is released from the locked state. Simultaneously, the actuating portion 31*b* of the lock lever 31 is brought into engagement with the abutment portion 43*b* of the connection arm 43 so as to tilt the latter leftward, thereby moving the connection pin 26*a* of the actuating link 26 from the bore 43*a* of the connection arm 43. Then the attachment frame 30 is lifted in this state and detached from the throat plate 18. Subsequently, the cover plate 22 is moved to close the opening 20. As a result, the upper surfaces of the upper plate 16, throat plate 18 and the cover plate 22 in combination constitute a work supporting surface. The ordinary sewing operation is smoothly conducted making full use of the entire part of this work supporting surface.

Although the invention has been described through its preferred form, it is to be noted that such a description is not made in a limiting sense but various changes and modifications may be imparted to the described embodiment.

For instance, it is possible to arrange it so that the movable trimming device is placed movable between a storing position in the machine bed and an operating position on the machine bed, and that the trimming device is operatively connected to the motion mechanism of the sewing machine at least when it takes the operating position. Changes of manners of attaching the stationary and movable blades, construction of these blades, shape of the resilient plate and so forth can suitably be made without departing from the scope and spirit of the invention.

As has been described, according to the invention, there is provided a trimming device having a frame, a trimming section consisting of a stationary and a movable blade, the frame and the stationary blade in combination forming a gap therebetween for allowing at least the movable blade to advance thereinto, a resilient plate which is fixed at its base portion to the frame and having a free end positioned in the vicinity of the trimming section to cover the gap, the free end of the resilient plate usually occupying substantially the same horizontal plane as the cutting edge of the stationary blade, and the free end of the resilient plate being adapted to be contacted by the movable blade and resiliently deflected by the movable blade as the latter is lowered, so as to come into the gap, and to resume the original position due to its resiliency as the movable blade is moved upward.

Therefore, when an overedge stitching is effected while performing an edge trimming of the work fabric with the trimming device mounted on the machine bed, the trimmings generated in the trimming section as the result of the trimming are prevented from coming into the machine bed through the aforementioned gap, and are easily removed from the trimming section. Consequently, the unfavourable disturbance of the trimming and overedge stitching by the stay and accumulation of the trimmings is fairly avoided.

In the described embodiment, a gap for admitting the feed dog is formed continuously from the gap for admitting the movable cutting blade, between the cutting edge of the stationary blade and the projection arm. This arrangement affords an easier and more sufficient deflecting of the free end of the resilient plate. Also, the removal of the trimmings is rendered more smooth by the provision of the deflecting part on the resilient plate as in the described embodiment.

What we claim is:

1. A trimming device for a sewing machine having a bed including a work support surface formed with an opening, a cover plate for openably closing said opening, and a motion mechanism mounted in said bed and including a work feeding mechanism, said trimming device comprising: a frame formed with a projection arm, means for removably holding said frame on said bed with said projection arm situated in said opening, a lower stationary blade secured to said projection arm and having a cutting edge which is situated at substantially the same level as said work supporting surface, a vertically-extending gap being formed between said cutting edge and a part of said projection arm, an upper movable blade having a cutting edge for trimming the marginal edge of a work fabric in co-operation with said cutting edge of said stationary blade, driving means mounted on said frame for reciprocating said movable blade up and down in timed relation with said motion mechanism in said bed, said driving means including locking means adapted to be operably connected with said motion mechanism at least when said frame is held on said bed, said cutting edge of said movable blade penetrating into said gap on the downward movement of said movable blade by the operation of said driving means, and a resilient plate secured at one end thereof to said projection arm for substantially covering said gap with the other end which is normally situated at substantially the same level as said cutting edge of said stationary blade, thereby on the downward movement of said movable blade said resilient plate is deflected into said gap by means of contact with said movable blade, and on the subsequent upward movement of said movable blade said resilient plate returns to the normal position.

2. A trimming device for a sewing machine according to claim 1, wherein said resilient plate is spaced slightly from the cutting edge of said stationary blade, thereby preventing engagement of a tip of the cutting edge of said movable blade with said resilient plate.

3. A trimming device for a sewing machine according to claim 1, wherein a second gap is defined for permitting a feed motion of a feed dog in said work feeding mechanism, said second gap acting in conjuction with said gap for said movable blade, and said second gap is also covered with said resilient plate so as to bring about the sufficient deflection of said resilient plate on the downward movement of said movable blade.

4. A trimming device for a sewing machine having a bed including a work supporting surface formed with an opening, a cover plate for openably closing said opening, and a work feeding mechanism in said bed, said trimming device comprising; an attachment frame formed with a projection arm, means for detachably mounting said frame on said bed with said projection arm situated in said openig, said projection arm having an upper surface which is substantially continuous with said work supporting surface in the state in which said frame is mounted on said bed, a lower stationary blade secured to said projection arm and having a cutting edge which is situated at substantially the same level as said work supporting surface, a vertically-extending gap being formed between said cutting edge and a free end of said projection arm, an upper movable blade having a cutting edge for trimming the marginal edge of a work fabric in co-operation with said cutting edge of said stationary blade, driving means mounted on said attachment frame for reciprocating said movable blade up and down in timed relation with said work feeding mechanism, said driving means being releasably connected with said work feeding mechanism through said opening, said cutting edge of said movable blade penetrating into said gap on the downward movement of said movable blade by the operation of said driving means, and a resilient plate secured at one end thereof on said upper surface of said projection arm for substantially covering said gap with the other end which is normally situated at substantially the same level as said cutting edge of said stationary blade, whereby on the downward movement of said movable blade said resilient plate is deflected into said gap by means of contact with said movable blade, and on the subsequent upward movement of said movable blade said resilient plate returns to the normal situation.

5. A trimming device for a sewing machine according to claim 4, wherein said movable blade is formed with a guide projection extending into said gap and connecting with said cutting edge of said stationary blade, for guiding the trimming engagement of said movable blade with said stationary blade, and said resilient plate covers said gap except for the travel path of said guide projection.

* * * * *